US005522105A

United States Patent [19]

Fujiwara et al.

[11] Patent Number: 5,522,105

[45] Date of Patent: Jun. 4, 1996

[54] HEALTH PILLOW

[75] Inventors: Emiko Fujiwara, Honolulu, Hi.; Fujio Soga, Gifu, Japan

[73] Assignees: Ivy Inc., Honolulu, Hi.; Tokiwa Corporation (KK Tokiwa), Gifu, Japan; a part interest

[21] Appl. No.: 392,165

[22] Filed: Feb. 22, 1995

[30] Foreign Application Priority Data

Jun. 27, 1994 [JP] Japan ..... 6-168912

[51] Int. Cl.[6] ..... A47G 9/00

[52] U.S. Cl. ..... 5/644; 5/645; 5/448; 5/636; 5/911; 128/202.18

[58] Field of Search ..... 5/636, 638, 644, 5/645, 448, 468, 911; 128/202.18

[56] References Cited

U.S. PATENT DOCUMENTS

| | | | |
|---|---|---|---|
| 4,903,356 | 2/1990 | Morisaki | 5/448 X |
| 4,995,127 | 2/1991 | Inagaki | 5/448 |
| 5,038,431 | 8/1991 | Burgin et al. | 5/641 |
| 5,105,490 | 4/1992 | Shek | 5/448 |
| 5,152,019 | 10/1992 | Hirata | 5/636 X |
| 5,168,588 | 12/1992 | Chan | 5/448 |
| 5,363,524 | 11/1994 | Lang | 5/644 X |

FOREIGN PATENT DOCUMENTS

| | | |
|---|---|---|
| 61-139666 | 8/1986 | Japan . |
| 62-161311 | 7/1987 | Japan . |
| 64-10279 | 1/1989 | Japan . |
| 4-91168 | 8/1992 | Japan . |
| 4-329908 | 11/1992 | Japan . |
| 4-133777 | 12/1992 | Japan . |

*Primary Examiner*—Michael F. Trettel
*Attorney, Agent, or Firm*—Jacobson, Price, Holman & Stern

[57] ABSTRACT

A health pillow which emits the fragrance of wood and induces a pleasant mood leading to peaceful sleep. A plurality of cylindrical, hollow wood sections improve air circulation in the pillow while at the same time emitting a fragrance which lasts for a long time. Wooden sheets which include a plurality of half-cylindrical shaped pieces are fastened together to form a sheet of wooden tubes. This sheet is cut into individual tubes which are cut into pieces ranging in length from several millimeters to fifteen to sixteen millimeters, thus producing numerous small tubular pieces of wood. These small tubular pieces of wood are used to fill the interior of the pillow.

20 Claims, 2 Drawing Sheets

HEALTH PILLOW

FIELD OF THE INVENTION

This invention concerns a health pillow which emits a wood fragrance and gives rise to a pleasant mood, leading to sleep.

BACKGROUND OF THE INVENTION

In the publications of Tokkai-Sho 62-161311 (1987), Tokkai-Hei 4-329908 (1992), Tokkai-Sho 61-139668 (1986), Tokkai-Hei 64-10279 (1989), Tokkai-Hei 1-151762 (1989), Jikkai-Hei 4-91168 (1992), and Jikkai-Hei 4-133777 (1992) pillows are disclosed which have had an interior portion of the pillow filed with Japanese cypress chips, based on the assumption that this would be useful for the mental and physical health of the user since the fragrant wood of the Japanese cypress and other fragrant trees has the effect of calming the heart and leading to sleep.

These health pillows used wood chips which are shaped like grains, sticks, sawdust or wood shavings. A problem is that these materials are very absorbent of moisture, and such pillows swell up with water and became heavy. Further their fragrant scent nearly vanishes after a short time.

SUMMARY OF THE INVENTION

This invention attempts to solve the above problems. Wood pieces are cut and pared into half-cylinder shapes. Two half-cylinder sections are joined together to form a tubular wooden piece. Small tubes of wood are made by cutting the tubular wooden piece into lengths ranging from several millimeters (2–3 mm) to fifteen or sixteen millimeters long. These numerous small wooden cylinders are used to stuff the interior of the pillow.

Since the wooden pieces are in the shape of small tubes, air circulation through the tubes is good. At the same time, the wooden pieces always retain their freshness and emit fragrance for a long time.

It is an object of the present invention to provide a health pillow having a plurality of compartments filled with cylindrically shaped wooden pieces.

It is another object of the present invention to provide a health pillow having a plurality of compartments filled with cylindrically shaped wooden pieces with the compartments spread across an upper surface of the pillow and including mesh openings across each compartment to allow the fragrance of the wooden cylinders to escape.

It is yet another object of the present invention to provide a health pillow having a plurality of compartments filled with cylindrically shaped wooden pieces with the compartments spread across an upper surface of the pillow and including mesh openings across each compartment to allow the fragrance of the wooden cylinders to escape with the compartments sitting on top of a normal pillow filling.

It is still yet another object of the present invention to provide a health pillow having a plurality of compartments filled with cylindrically shaped wooden pieces with the compartments spread across an upper surface of the pillow and including mesh openings across each compartment to allow the fragrance of the wooden cylinders to escape with the compartments sitting on top of a normal pillow filling and with the wooden cylinders having been soaked in a fragrance.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
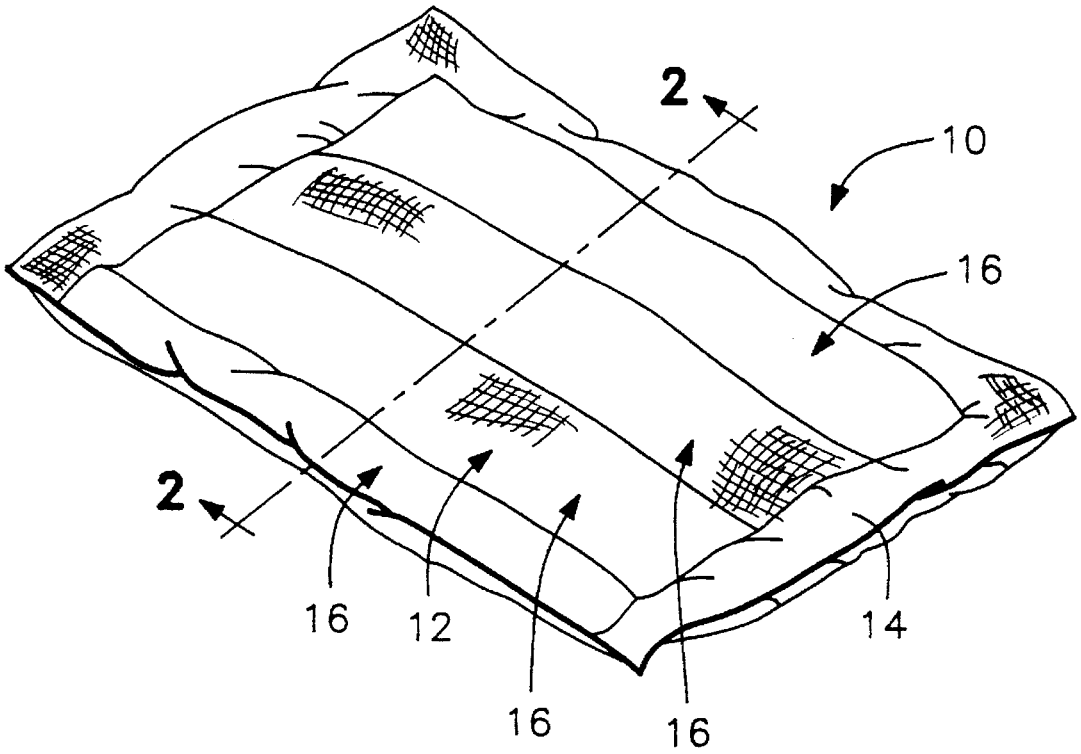
FIG. 1 is a perspective view of the health pillow of the present invention.
Figure 3:
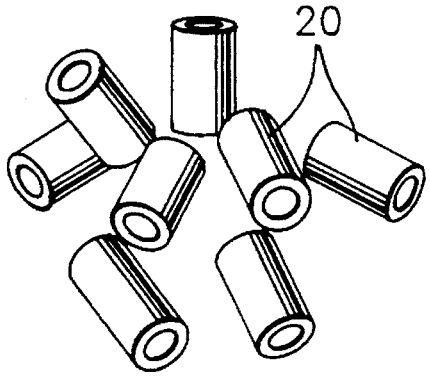
FIG. 3 illustrates a plurality of wooden cylinders used to stuff the interior of the pillow chambers shown in FIGS. 1 and 2.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
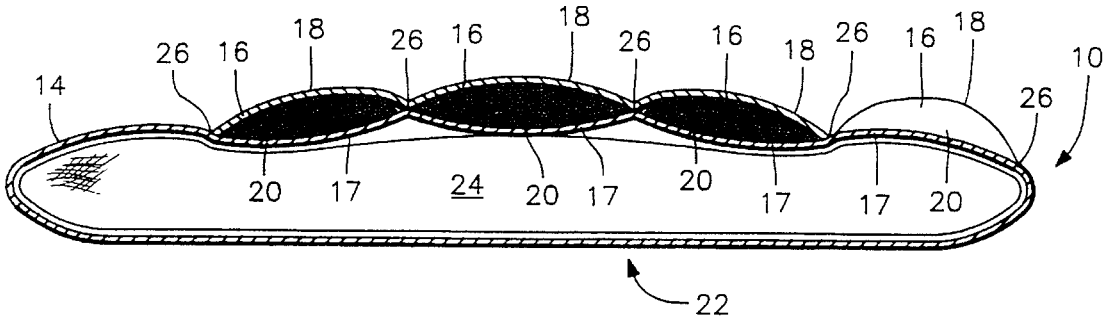
FIG. 2 is a cross sectional view taking along line 2—2 of FIG. 1.
Figure 4:
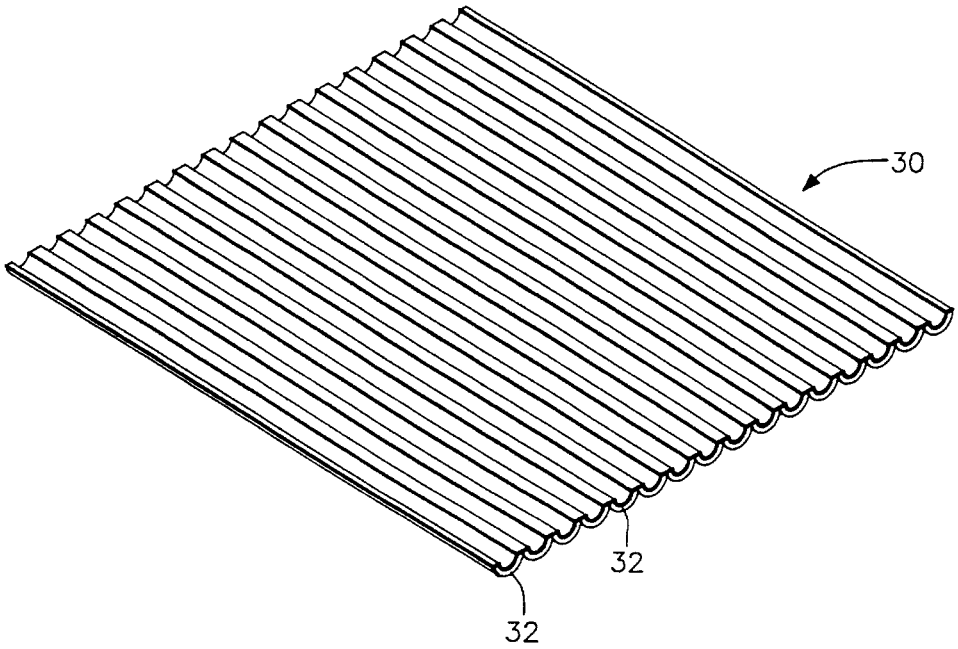
FIG. 4 is a perspective view of a wooden sheet cut to form a plurality of elongated semicircular members having an axially extending groove.
Figure 5:
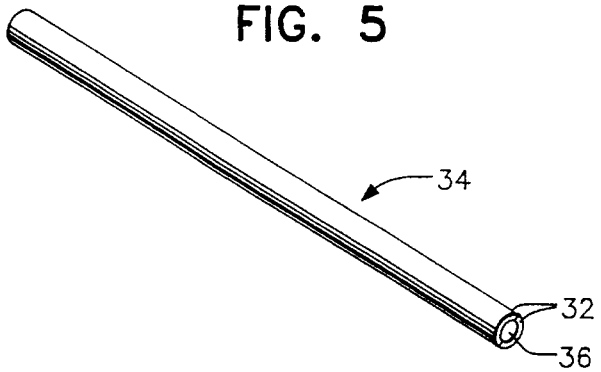
FIG. 5 is a perspective view of a tubular member formed by securing two sheets as shown in FIG. 4, together, and separating the thus formed tubular members, for subsequent cutting of each tubular member into lengths ranging from 2 to 16 millimeters.

With references to the drawings, in general, and to FIGS. 1 and 2, in particular, a pillow embodying the teachings of the subject invention is generally designated as 10. With reference to its orientation in FIG. 1, the pillow 10 is of a rectangular shape having formed on an upper surface 12 thereof, a three-sided border region 14 formed of a double layer of cotton fabric. Contained inside of the border 14 are four compartments 16 which on the front surface 12 are made of a mesh fabric material 18 including a plurality of apertures. As shown in FIG. 2, each of the compartments 16 include a plurality of cylindrically shaped hollow wooden tubes 20.

The bottom surface 17 of each compartment 16 as well as the top surface of border 14 and the entire surface of the bottom 22 of the pillow 10 is made of a cotton fabric surrounding a central stuffed portion 24 made of synthetic, down, or other pillow stuffing material. Numerous small wooden cylinders 20 are used to stuff the interior of the hollow compartments 16 which extend across the upper surface of the pillow 10 and which are separated by stitch lines 26.

To form the small wooden tubes 20, a procedure similar to that used in the manufacture of a pencil is used. Initially, a single sheet 30 of wooden material is cut to form a plurality of half cylindrical shaped pieces 32. Two wooden sheets 30 are then placed on top of each other and joined with adhesive so that opposed half cylinders are secured together to form a plurality of tubes of cylindrical shape.

A tube 34 formed of two joined half cylindrically shaped pieces 32 is cut from the two sheets 30 to form cylindrical pieces 34 having a centrally extending hollow space 36. The cylindrically shaped pieces of wood 34 are then cut into pieces 20 ranging in length from 2 to 16 millimeters, and preferably 3 to 15 millimeters in length. The pieces 20 have a width of 5–9 mm, preferably 6–8 mm, and most preferably 7 mm.

The cylindrical pieces 20 form the "stuffing" for compartments 16 of the pillow of the present invention. Each piece 20 is free to move within a compartment. The movement of the pieces 20 helps in spreading fragrance in the compartments and from the pillow.

In addition, the cylindrical shaped wooden pieces 20 may be soaked in a common insecticide to prevent the formation of mold and foul odors as well as to keep vermin away. Alternatively, the cylindrically shaped wooden pieces 20 can be soaked in a fragrance or have a fragrance sprayed upon them to provide an additional scent when these wooden pieces 20 are placed in the compartments 16 of the pillow of the present invention. It is understood that the pillow 10 is cloaked in a pillow case and is used as a normal pillow for sleeping.

By the present invention, a plurality of appropriately sized small wooden cylinders convey a pleasant "acupressure" type filling to a pillow for the head of a person trying to sleep while at the same time providing a wood fragrance causing a feeling of natural warmth and inducing sleep. Air can circulate freely through the passage-way of the small cylindrically shaped wooden pieces to provide excellent ventilation to keep the head properly cooled. In addition, moisture is absorbed and dispersed while a fragrance is simultaneously emitted from the interior passageway of the cylindrically shaped wooden pieces.

Because moisture does not easily adhere to the interior surfaces of the cylindrically shaped wooden pieces, the pillow remains fresh and is able to emit a pleasant fragrance over an extended period of time. In an alternate embodiment considered to be within the scope of the present invention, the cylindrical wooden pieces may be used as filling for cushions and back rests of assorted pillows in furniture.

Having described the invention, many modifications thereto will become apparent to those skilled in the art to which it pertains without deviation from the spirit of the invention as defined by the scope of the appended claims.

We claim:

1. A pillow comprising:

padding, at least one isolated compartment resting on said padding, said at least one isolated compartment including a plurality of cylindrically shaped wooden pieces stuffed into said at least one compartment, said cylindrically shaped wooden pieces having a natural wood fragrance and being free to move around in said at least one compartment and with respect to one another.

2. A pillow as claimed in claim 1, wherein a cover of said at least one compartment is made of a mesh material.

3. A pillow as claimed in claim 1, wherein said at least one compartment is located on top of said padding.

4. A pillow as claimed in claim 1, wherein said cylindrically shaped wooden pieces are 2 to 16 mm in length.

5. A pillow as claimed in claim 4, wherein said cylindrically shaped wooden pieces are 3 to 15 mm in length.

6. A pillow as claimed in claim 4, wherein said cylindrically shaped wooden pieces are 5–9 mm in width.

7. A pillow as claimed in claim 1, wherein said cylindrically shaped wooden pieces emit a fragrance in addition to said natural wood fragrance.

8. A pillow as claimed in claim 1, wherein only said cylindrically shaped wooden pieces are in said at least one compartment.

9. A cushion comprising:

padding, at least one compartment secured to said padding and including a plurality of freely movable, cylindrically shaped wooden pieces contained therein, and said cylindrically shaped wooden pieces being the only stuffing in said at least one compartment and said cylindrically shaped wooden pieces having a natural wood fragrance.

10. A cushion as claimed in claim 9, wherein a cover of said at least one compartment is made of a mesh material.

11. A cushion as claimed in claim 9, wherein said cylindrically shaped wooden pieces are 2 to 16 mm in length.

12. A cushion as claimed in claim 11, wherein said cylindrically shaped wooden pieces are 3 to 15 mm in length.

13. A cushion as claimed in claim 11, wherein said cylindrically shaped wooden pieces are 5–9 mm in width.

14. A cushion as claimed in claim 9, wherein said cylindrically shaped wooden pieces emit a fragrance in addition to said natural wood fragrance, said fragrance being absorbed by said cylindrically shaped wooden pieces and emitted from the cylindrically shaped wooden pieces.

15. A pillow as claimed in claim 1, wherein said cylindrically shaped wooden pieces include two semi-circular sections fastened together to provide an axial passageway for flow through of air.

16. A pillow as claimed in claim 15, wherein said cylindrically shaped wooden pieces include two semi-circular sections fastened together to provide an axial passageway for flow through of air.

17. A pillow comprising:

a body having four edges defining extremities of the pillow, at least one compartment resting on said body and extending to one of said four edges of said body, said at least one compartment including a plurality of freely movable, cylindrically shaped wooden pieces contained therein, and a border region of said body surrounding said at least one compartment on three sides and extending to the remaining three edges of said body.

18. A pillow as claimed in claim 17, wherein said body includes a centrally stuffed portion.

19. A pillow as claimed in claim 17, wherein said cylindrically shaped wooden pieces emit a natural wood fragrance.

20. A pillow as claimed in claim 17, wherein said cylindrically shaped wooden pieces include two semi-circular sections fastened together to provide an axial passageway for flow through of air.

* * * * *